US006877548B1

(12) United States Patent
Chartier et al.

(10) Patent No.: US 6,877,548 B1
(45) Date of Patent: Apr. 12, 2005

(54) INDIRECT LIGHTING SYSTEM FOR VERTICAL BLINDS AND THE LIKE

(76) Inventors: Clifford Eugene Chartier, 10161 Edgewood La., Garden Grove, CA (US) 92840; Michael Paul Chartier, 5534 Citrus, Whittier, CA (US) 90601

( * ) Notice: Subject to any disclaimer, the term of this patent is extended or adjusted under 35 U.S.C. 154(b) by 16 days.

(21) Appl. No.: 10/196,069

(22) Filed: Jul. 15, 2002

(51) Int. Cl.[7] ..... E06B 9/30

(52) U.S. Cl. ..... 160/178.1 V; 160/10; 160/127

(58) Field of Search ..... 160/178.1 V, 173 V, 160/177 V, 168.1 R, 168.1 V, 10, 38, 39, 19, 127, 900; 362/151, 253, 362

(56) References Cited

U.S. PATENT DOCUMENTS 2,478,699 A * 8/1949 Lange ..... 160/127
2,564,865 A * 8/1951 Turner et al. ..... 160/19
2,662,163 A * 12/1953 Mollner ..... 362/253
2,708,711 A * 5/1955 McGinty et al. ..... 362/253
4,533,981 A * 8/1985 Radek ..... 362/151
5,042,548 A * 8/1991 Attal ..... 160/38
5,148,849 A * 9/1992 Faludy ..... 160/10 X
5,412,553 A * 5/1995 Wojski ..... 362/253
5,908,179 A * 6/1999 Fimbres ..... 160/10
6,388,404 B1 * 5/2002 Schnebly et al. ..... 318/16

* cited by examiner

*Primary Examiner*—David Purol
(74) *Attorney, Agent, or Firm*—Edward S. Wright

(57) ABSTRACT

Indirect lighting system having an elongated housing or reflector which can be mounted on the headrail of a vertical blind or the like, with a light source disposed centrally of the housing or reflector for illuminating the surface of the blind. In some disclosed embodiments, the housing is mounted in a stationary position, and in others the reflector rotates to control the direction in which the light shines. Wiring for the system is concealed, and in some embodiments, the system includes a valance with removable panels overlying the housing.

30 Claims, 4 Drawing Sheets

Fig. 6
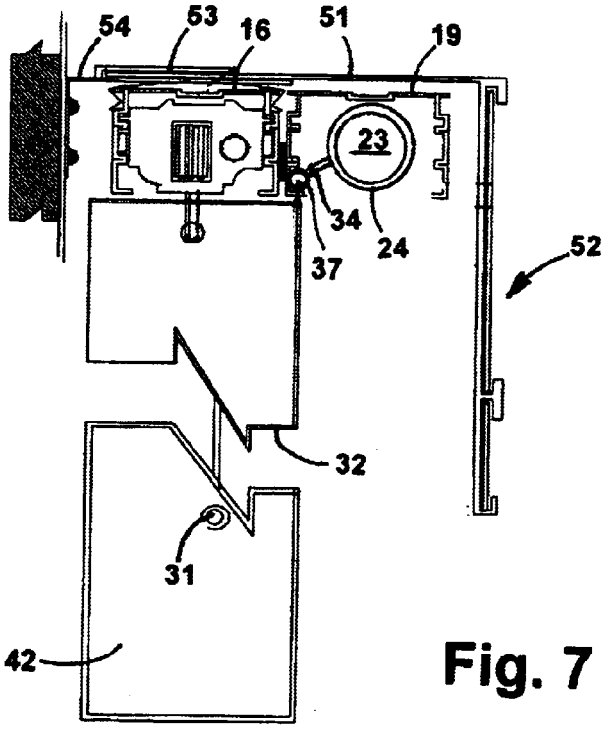
Fig. 7
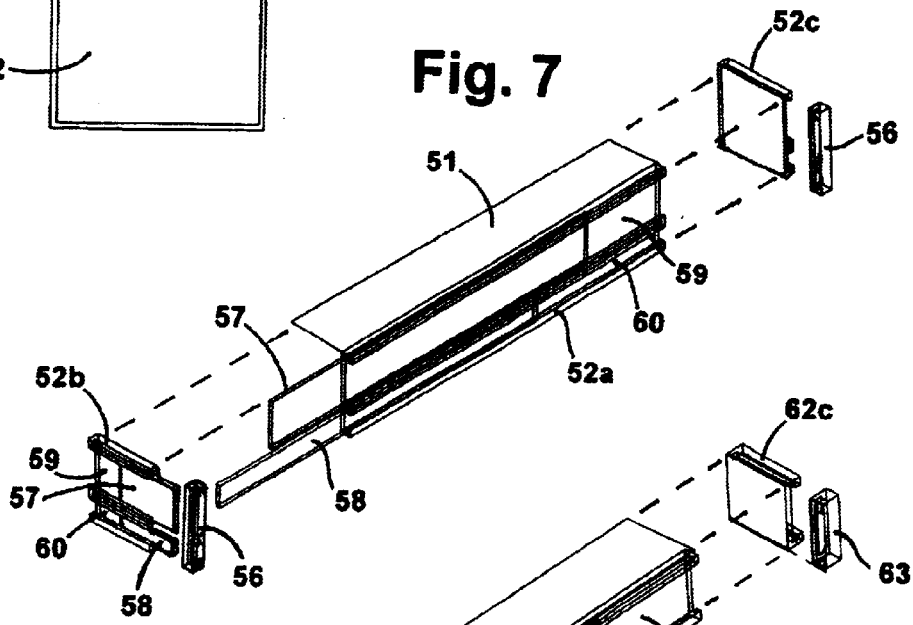
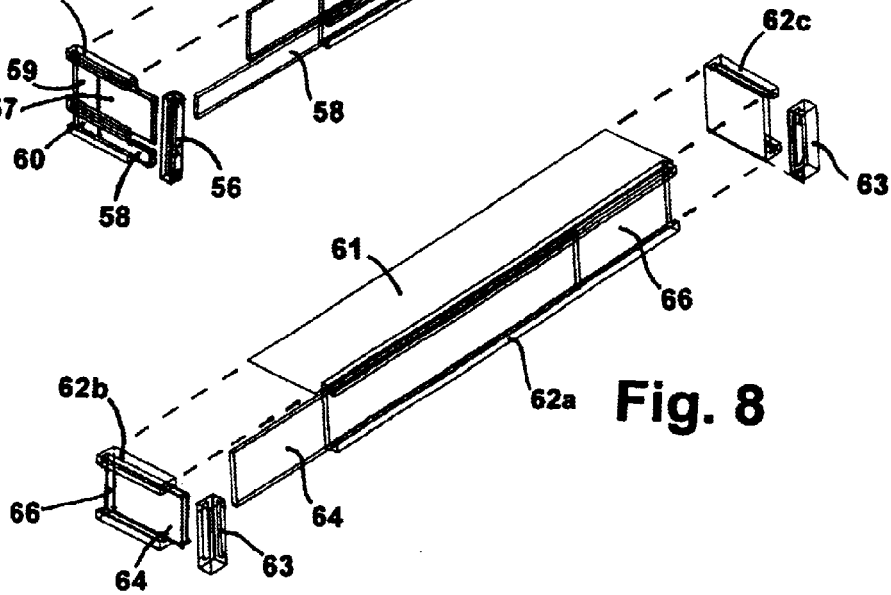
Fig. 8

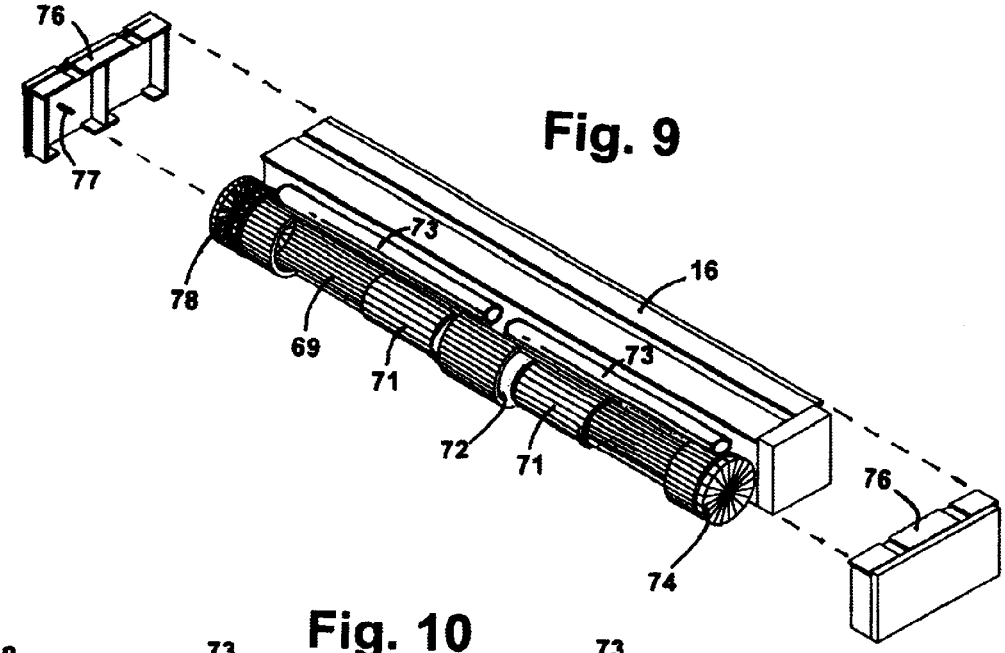
Fig. 9
Fig. 10
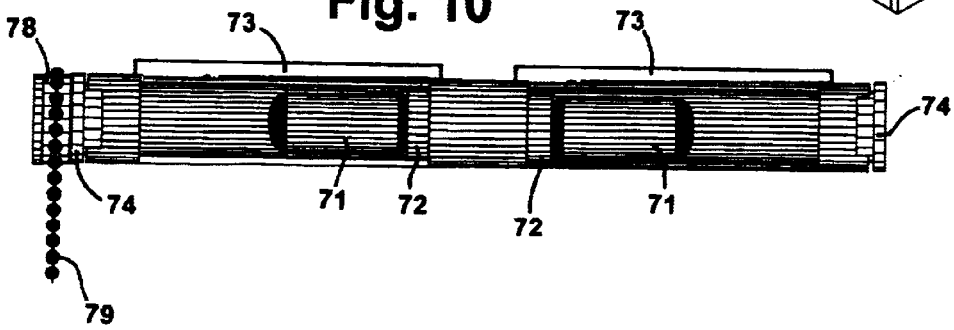
Fig. 11
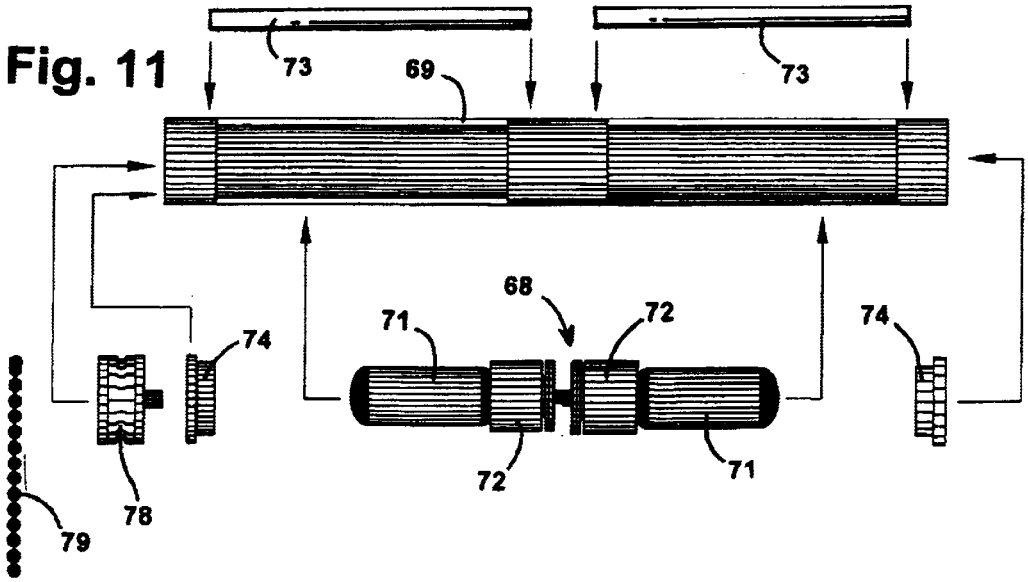

INDIRECT LIGHTING SYSTEM FOR VERTICAL BLINDS AND THE LIKE

BACKGROUND OF THE INVENTION

1. Field of Invention

This invention pertains generally to interior decoration and design and, more particularly, to an indirect lighting system for lighting the surface of vertical blinds and the like. It is the subject of Disclosure Document No. 491,329, filed Mar. 30, 2001.

2. Related Art

Vertical blinds and other screening devices such as Venetian blinds, curtains, drapes, window shades and mirrored doors are used in a variety of applications in which it would be desirable to have decorative lighting effects on their surfaces.

OBJECTS AND SUMMARY OF THE INVENTION

It is in general an object of the invention to provide a new and improved lighting system for vertical blinds and the like.

Another object of the invention is to provide a lighting system of the above character which is cost-effective to build and install.

Another object of the invention is to provide a lighting system of the above character which can be used with existing installations of vertical blinds and the like.

These and other objects are achieved in accordance with the invention by providing an indirect lighting system having an elongated housing or reflector which can be mounted on the headrail of a vertical blind or the like, with a light source disposed centrally of the housing or reflector for illuminating the surface of the blind. In some disclosed embodiments, the housing is mounted in a stationary position, and in others the reflector rotates to control the direction in which the light shines. Wiring for the system is concealed, and in some embodiments, the system includes a valance with removable panels overlying the housing.

BRIEF DESCRIPTION OF THE DRAWINGS

FIG. 6 is a cross-sectional view of the embodiment of FIG. 1.

FIG. 7 is an exploded isometric view of the valance in the embodiment of FIG. 1.

FIG. 8 is an exploded isometric view of another embodiment of a valance which can be used in the embodiment of FIG. 1.

FIG. 9 is an isometric, partly exploded, of another embodiment of a lighting system according to the invention.

FIG. 10 is a front elevational view of the embodiment of FIG. 9.

FIG. 11 is an exploded view of the embodiment of FIG. 9.

Figure 1:
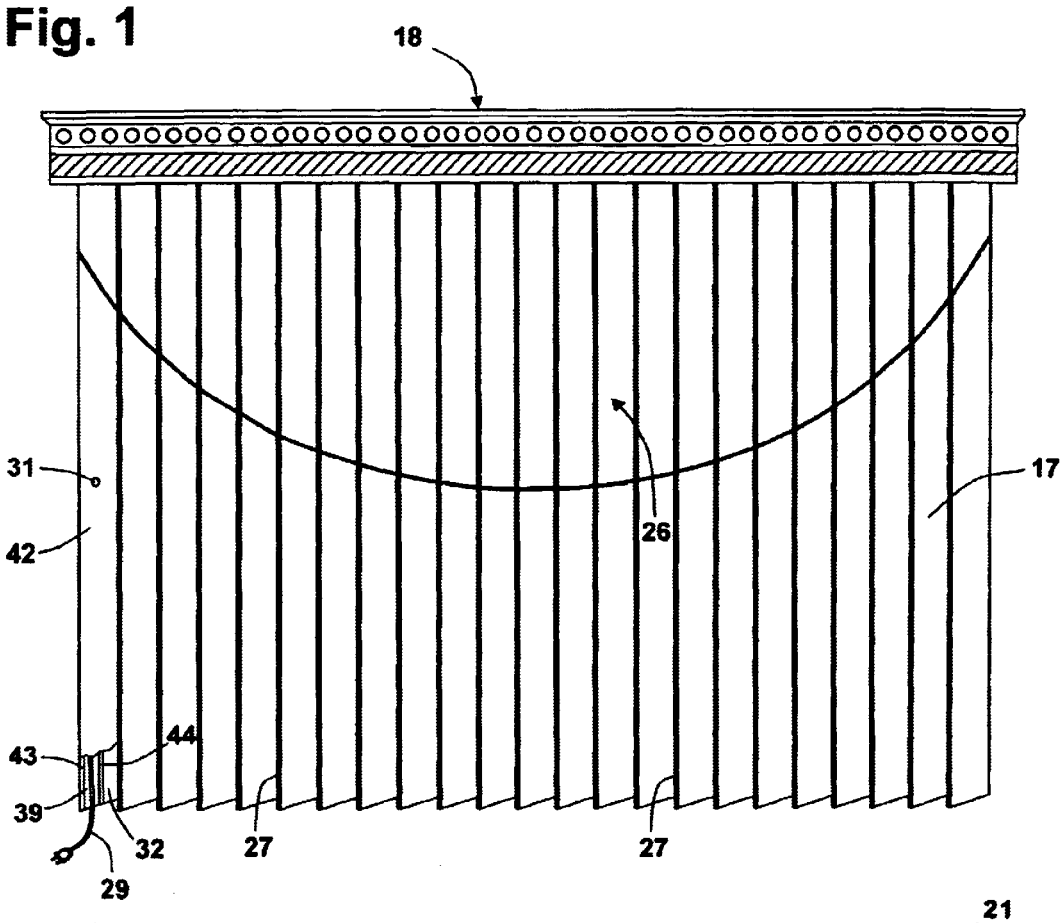
FIG. 1 is a front elevational view, partly broken away, of one embodiment of a vertical blind assembly with an indirect lighting system in accordance with the invention.
Figure 2:
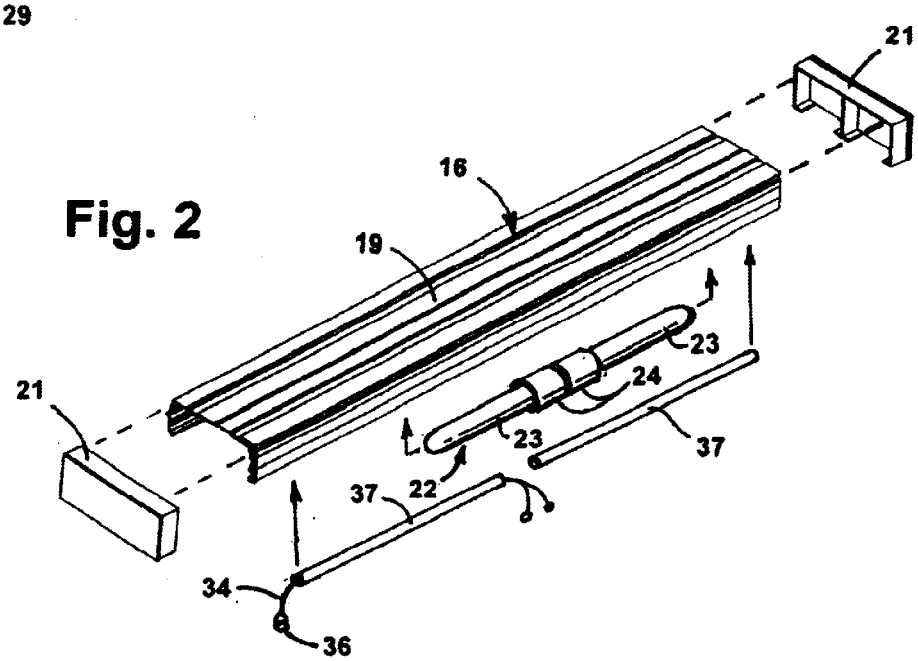
FIG. 2 is an exploded isometric view of the lighting system in the embodiment of FIG. 1.

The vertical blind system illustrated in FIG. 1 includes a horizontally extending headrail 16, with a plurality of vertically extending slats or louvers 17 hanging from it. This assembly is of conventional design and includes means (not shown) for rotating the louvers about their vertical axes between open and closed positions. The headrail is behind a valance 18 and is not visible in FIG. 1.

The lighting system includes a housing 19 which is attached to headrail 16 by a pair of end caps 21. The headrail and housing are coextensive in length, and in the embodiment illustrated, they are both fabricated of an extruded stock which is commonly used in headrails of this type. The extrusion is made of a rigid, lightweight material such as aluminum, and for installations up to about 12 feet in length, the end caps are all that is required to hold the headrail and the housing together. For longer installations, the two extrusions can be secured together at suitable intervals to prevent sagging.

The headrail and housing are generally U-shaped in cross section, and they are oriented with their open sides facing down, with the housing extending along the front side of the headrail. The end caps snap into place on the end portions of the headrail and housing to secure the two together.

A light source 22 is mounted in housing 19 midway between the ends of the housing, above the center portion of the blind. In the embodiment illustrated, the light source consists of a pair of tubular incandescent light bulbs 23 mounted in sockets 24 which are attached the housing by suitable means such as screws (not shown). The bulbs are substantially shorter than the housing, and the light from them is directed down through the open side of the housing onto the face of the blind, producing a generally semicircular area of illumination 26 in the upper central portion of the blind and deep shadows 27 along, the overlapping edges of the louvers. This provides the appearance of a half moon shining through the blinds and is visually quite spectacular.

Electric power for the light source is obtained from a conventional a.c. outlet (not shown) via a power cord 29, and controlled by an ON-OFF switch 31 which is mounted on the louver 32 at one end of the blind. The cord is routed up the louver to the switch, and from the switch to the top of the louver where it terminates in a female connector,33. Wires 34 extend between connector 33 and the light source, with a male connector 36 mating with connector 33. These wires are routed through a tubular conduit 37 which extends within the housing between the end of the housing and the light sockets. A conduit is provided at each end of the housing so that the cord and switch can be located at either end of the blind.

Although illustrated as being a rotary switch, switch 31 can be another type of switch, such as a toggle switch, or even a dimmer, if desired.

Figure 3:
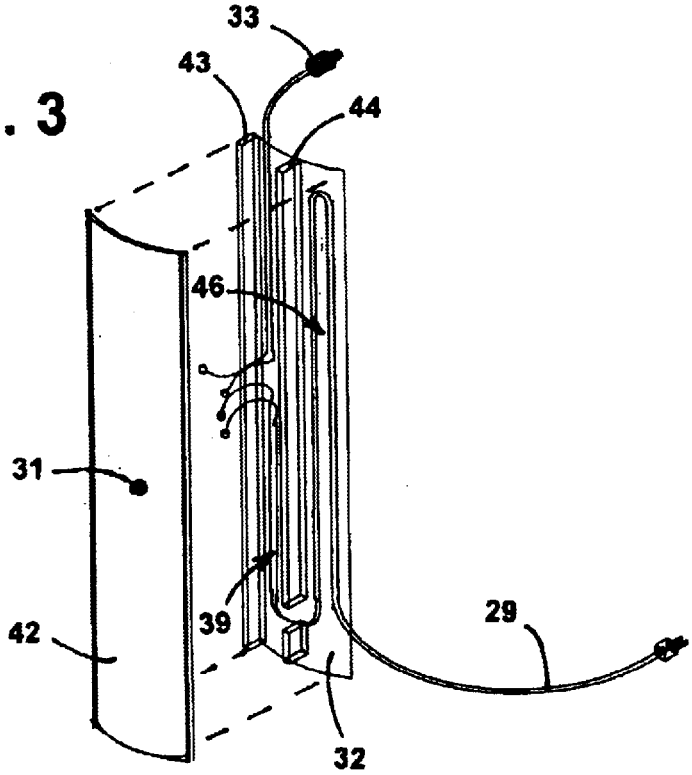
FIG. 3 is an exploded isometric view of a louver assembly in which a power cord is concealed and stored in the embodiment of FIG. 1.

In the embodiment illustrated in FIG. 3, the power cord is concealed in a channel 39 on louver 32. The channel is formed between that louver and an overlying louver 42, with a pair of vertically extending ribs 43, 44 between the two louvers. Rib 43 extends along the outer edge of the louvers, rib 44 is spaced inwardly from it, and the inner edge portions of the two louvers are in facing abutment so that the assembly is generally triangular in horizontal section.

Switch 31 is mounted on the front louver or cover, with the body of the switch extending into the channel. If the cord is longer than needed to reach the outlet, the extra portion of the cord can be stored in a compartment 46 which is formed between inner rib 43 and the inner edges of the louvers.

Figure 4:
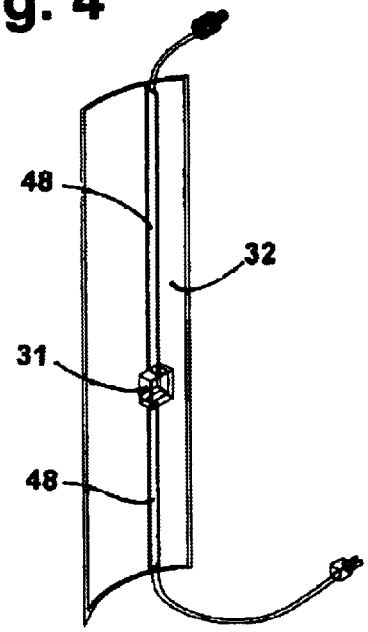
FIGS. 4 and 5 are a rear isometric views of a louver in the embodiment of FIG. 1, illustrating additional ways to conceal the power cord.
Figure 5:
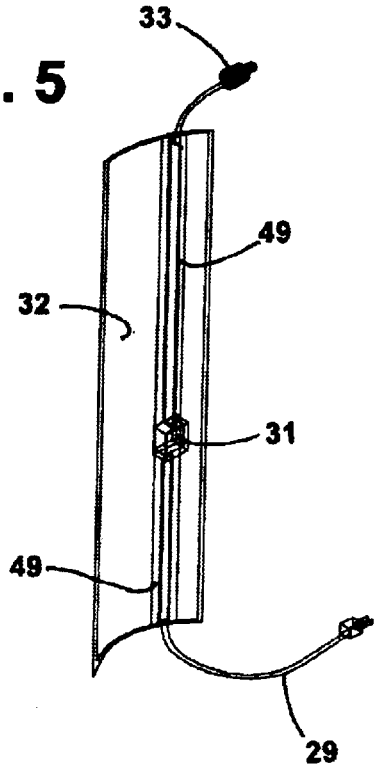

Alternate embodiments for routing the power cord are shown in FIGS. 4 and 5. In the embodiment of FIG. 4, the cord is routed through a pair of tubular conduits 48 which are affixed to the back side of louver 32, and in the embodiment of FIG. 5, it is affixed to the back side of the louver and concealed by duct tape 49. Either the conduit or the duct tape can be made relatively inconspicuous by making it the same color as the louver, e.g. white.

As best seen in FIGS. 6–7, valance 18 has a horizontal mounting flange 51 and a depending vertical panel or skirt 52 which covers the face of the housing and the ends of the housing and the headrail, concealing them from view. The flange extends across the tops of the headrail and the housing, and is held in position by clips 53 on the mounting brackets 54 for the headrail.

The skirt has a front section 52*a* and end sections 52*b*, 52*c* which fit together with the mounting flange and with cornerpieces 56, and decorative inserts 57, 58 are mounted in horizontally extending slots 59, 60 in the outer faces of the three skirt sections. The inserts are replaceable in the sense that the valance assembly snaps together, and the cornerpieces are easily removed to permit the insets to be slid into and out of the slots.

In a presently preferred embodiment, the skirt is fabricated of an extruded material such as plastic, and can be made with any desired combination of slots. In the embodiment illustrated, upper insert 57 is wider or taller than lower insert 58, but the inserts could just as well be of equal width, or the lower insert could be wider than the upper one. A greater or lesser number of inserts can also be provided, if desired. The valance is taller than those normally found on decorative blinds, and the added height provides room for multiple inserts.

The valance also differs from the valances commonly used with blinds in that it can be colored rather than being transparent. This adds a secondary color to the valance, which tends to enhance or frame the inserts.

The inserts can be of any desired material, color or pattern. In one presently preferred embodiment, the upper insert consists of a louver which is identical to the ones in the blind, and the lower insert is chosen to coordinate with or match the surrounding wall. It can, for example, be colored paper, fabric, a border paper, strips of floor tile, colored plastic, or wallpaper.

FIG. 8 illustrates another embodiment of a valance which can be utilized in the invention. This embodiment is similar to the embodiment of FIG. 7 in that it has a mounting flange 61 and a depending skirt with front and end sections 62*a*–62*c*, and cornerpieces 63. However, it is somewhat more conventional than the embodiment of FIG. 7 in that it has only one decorative insert 64 which is mounted in a single horizontally extending slot 66.

The valance of FIG. 8 is not as tall as the embodiment of FIG. 7, and it is suitable for use where lower cost and/or a lighter appearance is desired.

FIGS. 9–11 illustrate an embodiment in which the light source can be rotated or turned to direct light selectively onto the face of the blind and/or onto the ceiling above the blind. In this embodiment a light source 68 is mounted in an semicylindrical reflector 69 which can be rotated or pivoted about a horizontally extending axis.

Light source 68 is similar to light source 22, and includes a pair of tubular bulbs 71 mounted in sockets 72 toward the center of the reflector. Wiring for the light source is routed through elongated tubular conduits 73 which are affixed to the outer surface of the reflector. These conduits are positioned on the reflector for abutting engagement with headrail 16 to limit the rotation of the reflector.

The reflector includes end plugs 74 and is mounted on the headrail by means of end caps 76 which snap onto the headrail and have axially aligned pivot pins 77 on which the reflector is mounted. A sprocket 78 is affixed to one of the end plugs, with a chain 79 is trained about it for adjusting the position of the light source and reflector.

When the embodiment of FIGS. 9–11 is utilized with vertical blinds, the power cord can be concealed within or behind one of the louvers, as discussed above, with a power switch or dimmer mounted on the louver.

The invention has a number of important features and advantages. It provides an attractive and economical way to illuminate vertical blinds and other surfaces, and it is readily attached to the headrails of existing blinds as well as being used in new installations.

It is apparent from the foregoing that a new and improved lighting system for vertical blinds and the like has been provided. While only certain presently preferred embodiments have been described in detail, as will be apparent to those familiar with the art, certain changes and modifications can be made without departing from the scope of the invention as defined by the following claims.

What is claimed is:

1. An indirect lighting system for illuminating the surface of a vertical blind having a horizontally extending headrail and a plurality of vertically extending louvers hanging from the headrail, comprising: an elongated reflector pivotally mounted on the headrail for rotation about a horizontally extending axis, a light source disposed centrally and coaxially of the reflector, and means for adjusting the rotational position of the reflector to direct light from the source in a desired direction relative to the surface of the blind.

2. The lighting system of claim 1 wherein the reflector has a semicircular profile.

3. The lighting system of claim 1 including a power switch mounted on one of the louvers, and electrical wires connected to the switch and concealed by the louver for supplying operating power to the light source.

4. The lighting system of claim 3 wherein the wires are concealed in a channel formed between the louver and a cover in juxtaposition with the louver.

5. The lighting system of claim 3 wherein the wires are disposed in a vertically extending tube on the back side of the louver.

6. The lighting system of claim 3 wherein the wires are attached to the back side of the louver and covered by tape.

7. An indirect lighting system for illuminating the surface of a vertical blind having a horizontally extending headrail and a plurality of vertically extending louvers hanging from the headrail, comprising: a pair of end caps mounted on opposite ends of the headrail with axially aligned pivot pins carried by the end caps in front of the headrail, an elongated semicylindrical reflector pivotally mounted on the pins for rotation about a horizontally extending axis, a light source disposed centrally and coaxially of the reflector, a sprocket affixed to the reflector, and a chain trained about the sprocket for adjusting the rotational position of the reflector to direct light from the source in a desired direction relative to the surface of the blind.

8. The lighting system of claim 7 including an elongated tubular conduit mounted on the reflector for carrying wires connected to the light source and abutting against the headrail to limit the rotation of the reflector.

9. The lighting system of claim 7 including a power switch mounted on one of the louvers, and electrical wires connected to the switch and concealed by the louver for supplying operating power to the light source.

10. The lighting system of claim 9 wherein the wires are concealed in a channel formed between the louver and cover in juxtaposition with the louver.

11. The lighting system of claim 9 wherein the wires are disposed in a vertically extending tubular conduit on the back side of the louver.

12. The lighting system of claim 9 wherein the wires are attached to the back side of the louver and covered by tape.

13. An indirect lighting system for illuminating a vertical surface, comprising: a horizontally extending headrail mounted in a fixed position above the surface, an elongated reflector pivotally mounted on the headrail for rotation about a horizontally extending axis, a light source disposed coaxially of the reflector, and means for adjusting the rotational position of the reflector to direct light from the source in a desired direction relative to the surface.

14. The lighting system of claim 13 wherein the reflector has a semicircular profile.

15. The lighting system of claim 13 wherein the means for adjusting the rotational position of the reflector comprises a sprocket affixed to the reflector and a chain trained about the sprocket.

16. An indirect lighting system for illuminating the surface of a vertical blind having a horizontally extending headrail and a plurality of vertically extending louvers hanging from the headrail, comprising: an elongated housing with an open bottom positioned in front of the headrail, a pair of end caps securing the housing to the headrail, and a light source disposed centrally within the housing, with light from the source being directed through the open bottom toward the surface of the blind.

17. An indirect lighting system for illuminating the surface of a vertical blind having a horizontally extending headrail and a plurality of vertically extending louvers hanging from the headrail, comprising: an elongated housing with an open bottom positioned in front of the headrail, means securing the housing to the headrail, a light source disposed centrally within the housing, with light from the source being directed through the open bottom toward the surface of the blind, a power switch mounted on one of the louvers, and electrical wires connected to the switch and concealed by the louver for supplying operating power to the light source.

18. The lighting system of claim 17 wherein the wires are concealed in a channel formed between the louver and cover in juxtaposition with the louver.

19. The lighting system of claim 17 wherein the wires are disposed in a vertically extending tube on the back side of the louver.

20. The lighting system of claim 17 wherein the wires are attached to the back side of the louver and covered by tape.

21. The lighting system of claim 17 including a tubular conduit within the housing through which the wires extend between the light source and the louver.

22. The lighting system of claim 16 including a valance which extends along the front of the housing and the ends of the housing and the headrail.

23. The lighting system of claim 22 wherein the valance has upper and lower horizontally extending slots, and a decorative panel removably mounted in each of the slots.

24. An indirect lighting system for illuminating a vertical surface, comprising: an elongated housing with an open bottom mounted above the surface, and a light source disposed centrally within the housing, with light from the source being directed through the open bottom and illuminating a generally semicircular area in an upper central portion of the surface with the appearance of a half moon shining through the surface.

25. The lighting system of claim 24 including a tubular conduit within the housing, with electrical wires for powering the light extending through the conduit.

26. The lighting system of claim 24 including a valance which overlies the front and ends of the housing.

27. The lighting system of claim 26 wherein the valance has upper and lower horizontally extending slots, and a decorative panel removably mounted in each of the slots.

28. A lighting system, comprising: a blind having a horizontally extending headrail and a plurality of vertically extending louvers hanging from the headrail, an elongated housing with an open bottom positioned in front of the headrail, and a light source disposed centrally within the housing, with light from the source passing through the open bottom and illuminating a generally semicircular area in the upper central portion of the blind with the appearance of a half moon shining through the blind and deep shadows along overlapping edges of the louvers.

29. The lighting system of claim 28 wherein the light source comprises a tubular bulb which is substantially shorter than the housing.

30. A lighting system, comprising: a horizontally extending headrail, a plurality of vertically extending louvers hanging from the headrail with edge portions of adjacent ones of the louvers overlapping each other, an elongated housing with an open bottom positioned in front of the headrail, and a light source disposed centrally within the housing, with light from the source passing through the open bottom and illuminating a generally semicircular area on some of louvers with the appearance of a half moon shining through the louvers and deep shadows along the overlapping edge portions of the louvers.

* * * * *